US007188556B1

(12) United States Patent
Rinner

(10) Patent No.: US 7,188,556 B1
(45) Date of Patent: Mar. 13, 2007

(54) ROTATABLE HAND TOOL WITH A TORQUE CONTROLLER AND METHOD

(75) Inventor: James A. Rinner, Racine, WI (US)

(73) Assignee: Pilling Weck Incorporated, Horsham, PA (US)

( * ) Notice: Subject to any disclaimer, the term of this patent is extended or adjusted under 35 U.S.C. 154(b) by 156 days.

(21) Appl. No.: 10/962,330

(22) Filed: Oct. 12, 2004

(51) Int. Cl.
*B25B 23/14* (2006.01)
*B25B 23/153* (2006.01)

(52) U.S. Cl. ..... 81/467; 81/471; 81/477

(58) Field of Classification Search ..... 81/467, 81/471, 477, 478, 473–476, 436, 439
See application file for complete search history.

(56) References Cited

U.S. PATENT DOCUMENTS

| | | | | |
|---|---|---|---|---|
| 2,083,054 | A | 6/1937 | Cline | |
| 3,126,723 | A | 3/1964 | Dugay | |
| 3,247,735 | A | 4/1966 | Bonnafe | |
| 3,753,625 | A * | 8/1973 | Fabrizio et al. | 81/471 |
| 3,796,125 | A | 3/1974 | Campbell | |
| 4,411,635 | A | 10/1983 | Boothroyd | |
| 4,466,314 | A * | 8/1984 | Rich | 81/461 |
| 4,502,825 | A | 3/1985 | Yamada | |
| 4,703,677 | A | 11/1987 | Rossini | |
| 4,838,264 | A | 6/1989 | Bremer | |
| 5,120,168 | A | 6/1992 | Padula | |
| 5,186,079 | A | 2/1993 | Gee | |
| 5,368,480 | A | 11/1994 | Balfour | |
| 5,624,216 | A | 4/1997 | Detable | |
| 5,713,705 | A | 2/1998 | Grunbichler | |
| 6,308,598 | B1 | 10/2001 | O'Neil | |
| 6,330,846 | B1 * | 12/2001 | Strauch | 81/477 |
| 6,345,560 | B1 * | 2/2002 | Strauch et al. | 81/477 |
| 6,606,924 | B2 | 8/2003 | Chandler | |

* cited by examiner

*Primary Examiner*—Hadi Shakeri
(74) *Attorney, Agent, or Firm*—Baker & Hostetler LLP

(57) ABSTRACT

A hand tool rotatable about an axis and having a handle and a bit in alignment along the axis. A plurality of inserts are available for individual placement between the handle and the bit for controlling torque transmitted by the tool. The insert can provide for limited or unlimited torque, in accord with the construction of the individual insert. The insert is replaceable relative to the tool.

6 Claims, 7 Drawing Sheets

12
11
34
40
53
51
23
49
22
51
48
47
46
52
19

1. AUGH MARKS
2. LOAD INSERT
36
14
57

4
12
11
10
13
34
36
19
21
4

12
58

ROTATABLE HAND TOOL WITH A TORQUE CONTROLLER AND METHOD

This invention relates to a rotatable hand tool with a torque controller, and, more particularly, it relates to a tool that can be hand rotated about an axis and it has a controller to establish the amount of torque that can be transmitted by the tool. This invention is also a method of arranging the tool.

BACKGROUND OF THE INVENTION

The prior art is aware of devices and methods that transmit torque upon rotation about an axis, whether those devices be hand tools or other apparatus. Also, those devices and methods include types which have an element that has a limited strength so that the element will break upon being subjected to a certain magnitude of torque. Those elements act like a fuse in that they break to thereby disconnect the rotation drive through the tool. Patents filed herewith in the patent office show those prior art devices.

The present invention improves upon those prior devices and methods in that it provides for re-establishing the tool after it has been used and reached its full torque limit and has actually become disconnected when limiting the amount of torque that was transmitted. That is, the tool can limit the amount of transmitted torque, and it can then be re-used by being readily arranged to re-establish itself and again, in repeat use, limit the transmitted torque.

Further, alternative to the above, the tool and method can be arranged for either limiting the amount of torque or for not doing so. In all instances, the arrangement is according to the limit or no-limit mode in an easy, facile, and accurate manner. The precise amount of limited torque can be readily and accurately established, or there can be no limit on the amount of torque to be transmitted according to the power of the user's hand.

This invention can provide a kit of controls or inserts that can be individually selected and readily placed into the tool for the selected functions of either limiting or not limiting the torque. That is, this has controllers insertable into the tool for the desired function of controlling the torque, as mentioned. The tool can have a pocket to receive the insert and thereby securely hold the insert for the usual various dispositions of a tool that is rotated for applying fasteners or the like, as with this invention.

The tool can be locked in operative mode, and unlocked, through a maneuver of the tool parts and without the need for any special tools or fasteners. the locked mode secures the insert, and the unlocked mode renders access to the insert for removal thereof.

Other objects and advantages will become apparent to one skilled in the art upon considering the following description in conjunction with the drawings.

DETAILED DESCRIPTION OF A PREFERRED EMBODIMENT AND METHOD

The drawings show the tool of this invention in its several modes or conditions for loading and removing torque transmitting inserts or controllers. At this outset, it should be understood that the inserts are of varying shapes and strengths and materials, such as metal, plastic, and the like, all as desired by the manufacturer. The inserts are placed into and removed from the tool designated 10, according to the desires of the user. That is, the inserts can either provide maximum torque or unlimited torque transmitted by the user's hand through the tool 10.

As such, there is a kit of the tool 10 and varying inserts, with the inserts being for selection by the user to produce a limited or unlimited torque, according to the user's selection of one of the inserts.

Figure 17:
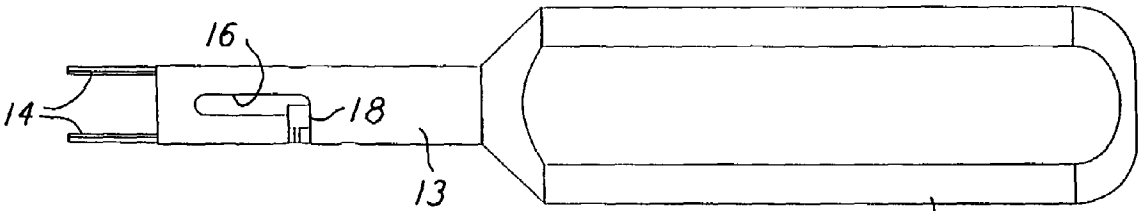
FIG. 17 is a top plan view of a part, a portion of which is shown in FIG. 10.
Figure 18:
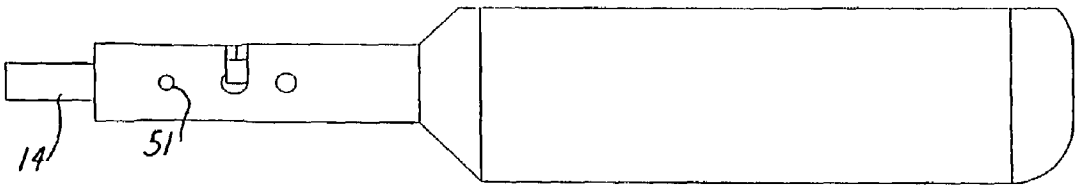
FIGS. 18 and 19 are respectively front and bottom views of FIG. 17.
Figure 19:
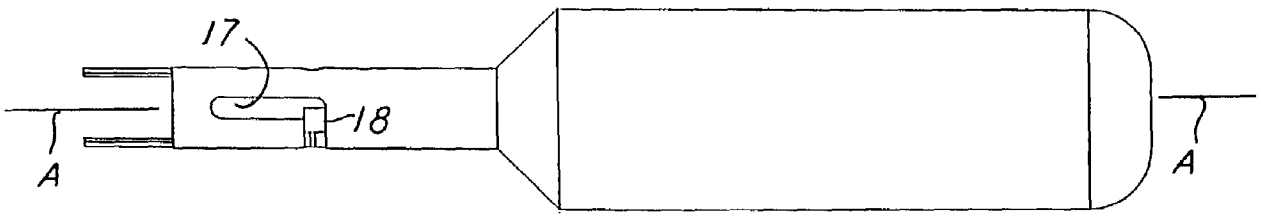
Figure 24:
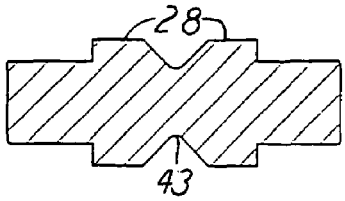
FIG. 24 is a section view taken on a plane designated by the line 24—24 in FIG. 22.
Figure 20:
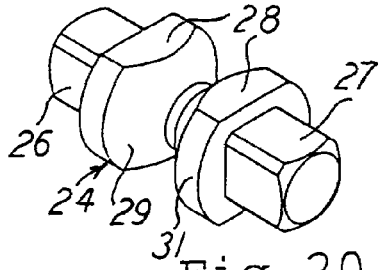
FIG. 20 is an enlarged perspective view of an insert shown in FIG. 10.
Figure 21:
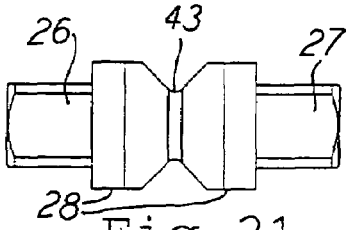
FIGS. 21, 22, and 23 are respectively front elevation and top plan and end elevation views of FIG. 20.
Figure 23:
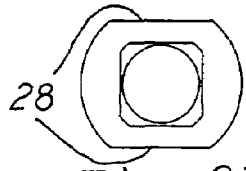

The tool 10 includes a handle 11, with a hand grip 12, and it has a cylindrical extension 13. FIGS. 17, 18, and 19 show the base handle 11 also has two extension and spaced-apart fingers or shutters 14. The portion 13 has two diametrically disposed slots 16 and 17 extending axially and relative to the tool longitudinal axis A shown in FIG. 19. Two quarter-circle slots or notches 18 respectively connect with the slots 16 and 17, and the slots 18 extend along the circumference of the cylindrical portion 13. The fingers 14 and the two slots 16 and 17 are orientated relative to each other in the rotational relationship.

Figures 1, 2, 3, 4:
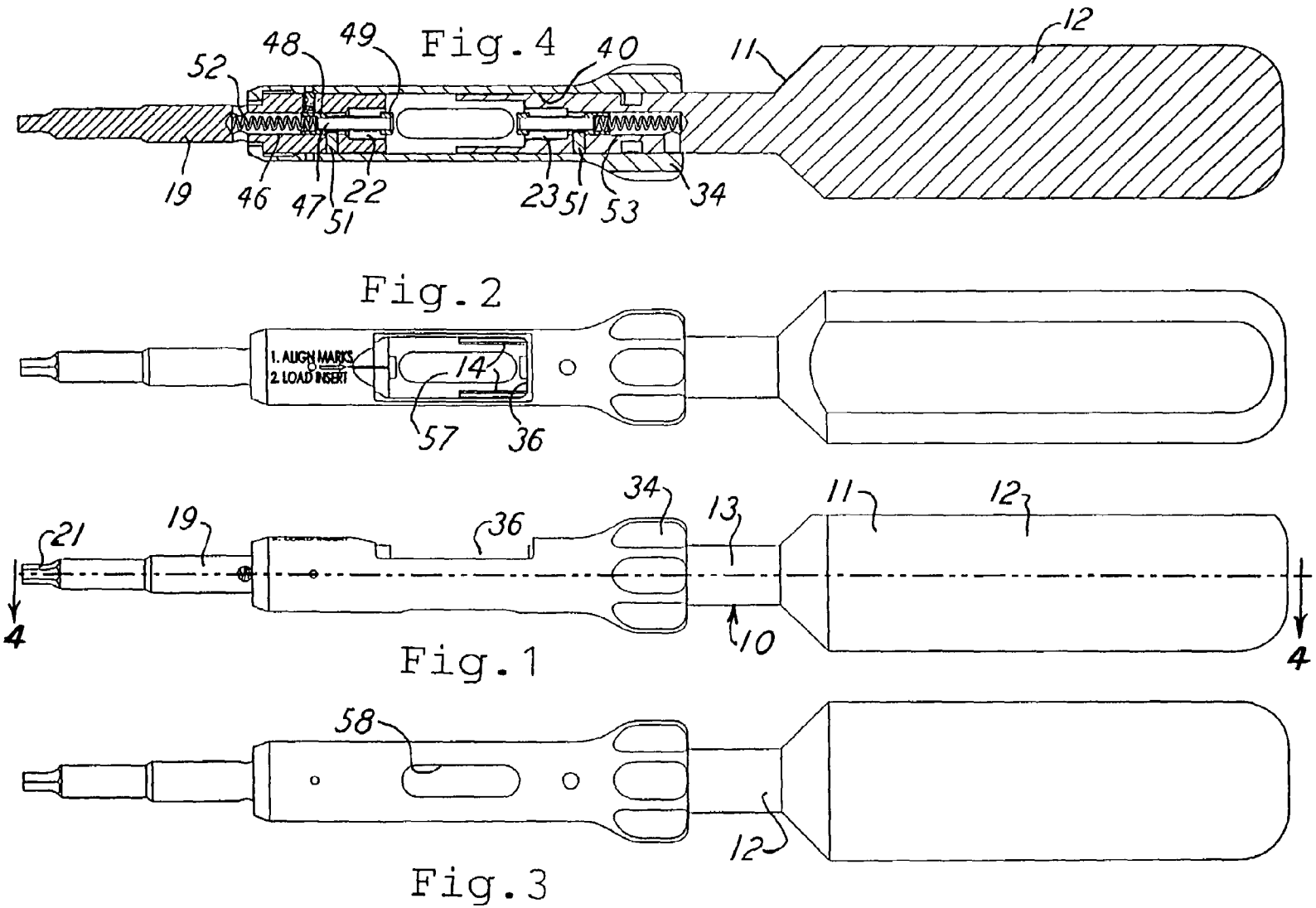
FIG. 1 is a side elevation view of a preferred embodiment of this invention, with the tool in the open extended and insert-receptive mode.
FIGS. 2 and 3 are respectively top and bottom views of FIG. 1.
FIG. 4 is a section view taken on a plane designated by the line 4—4 in FIG. 1.
Figure 11:
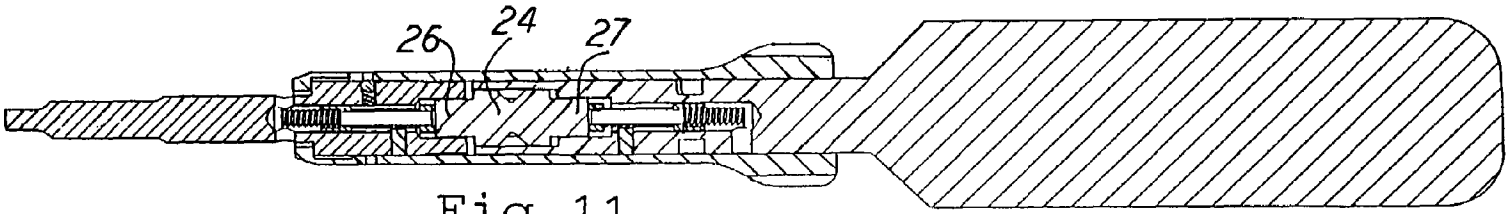
FIG. 11 is a section view taken on a plane designated by the line 11—11 in FIG. 9.

A tool bit 19 is axially disposed aligned with the handle 11 and it has a suitable connection portion 21 for releasably connecting to an unshown fastener, such as a screw, in a conventional manner. FIG. 4 shows that the handle 11 and the tool bit 19 have axially disposed and square-shaped respective sockets 22 and 23 facing each other along axis A, and the sockets 22 and 23 may be square or of other rectilinear and rotational drive cross-section shape. With an insert 24 seen in FIGS. 20–24 disposed intermediate the handle 11 and bit 19, as shown in FIG. 11, there can be rotation drive from the handle 11 to bit 19 and thus to the unshown fastener, as desired. That is, the insert 24, which can be one from a kit with a plurality of inserts, each with a unique rotational drive capacity, such as strength, and some can be at least somewhat centrally shaped as shown. The inserts can be made from different selected materials and torsional strengths, and they can have opposite ends 26 and 27 which are shaped to mate with the respective sockets 22 and 23 for the desired rotation drive connection mentioned.

Figures 5, 6, 7, 8:
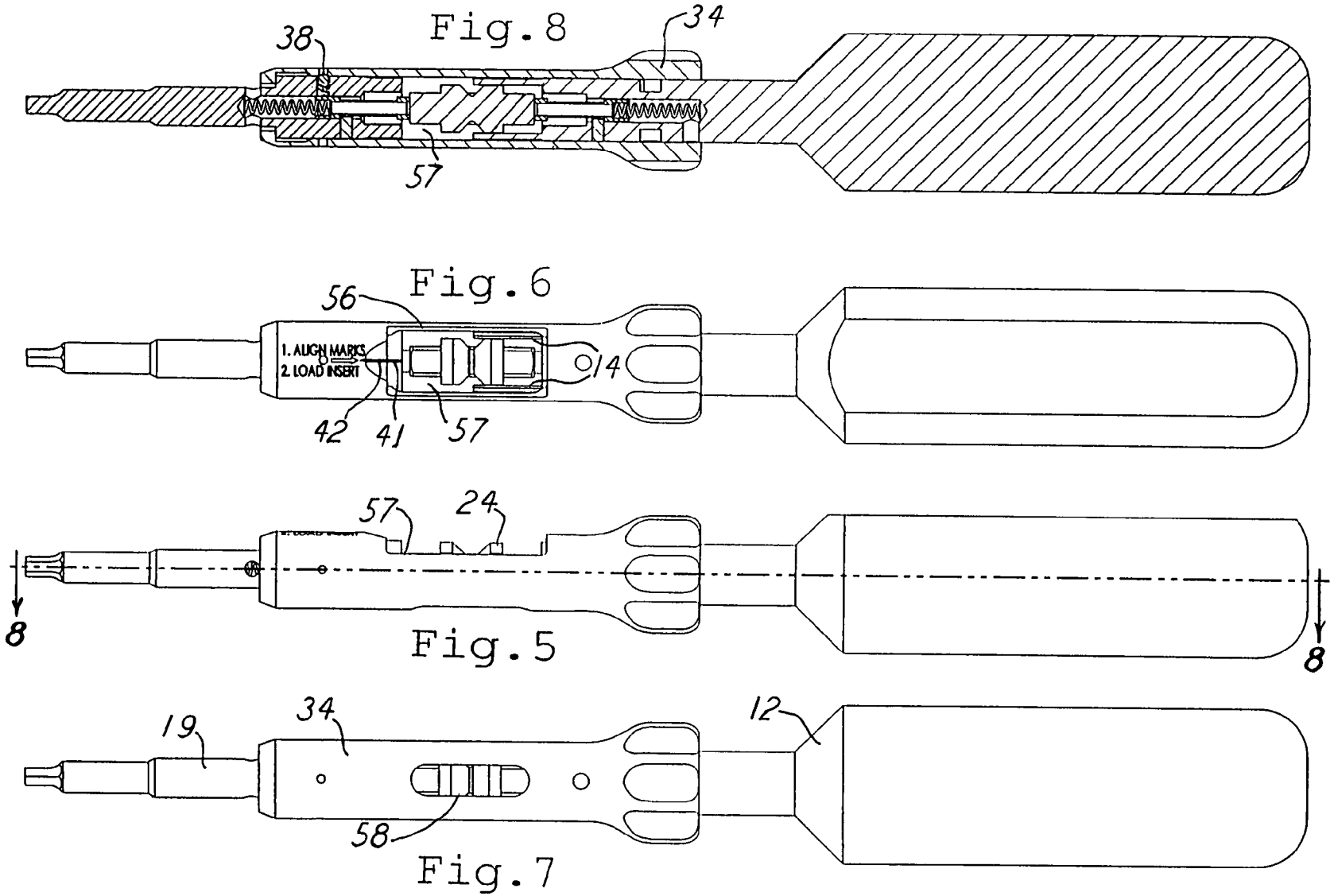
FIG. 5 is the FIG. 1 side elevation view, but with the insert therein.
FIGS. 6 and 7 are respectively top and bottom views of FIG. 5.
FIG. 8 is a section view taken on a plane designated by the line 8—8 in FIG. 5.

The inserts 24 have diametrically opposite flat sides 28 on each of two spaced-apart plates 29 and 31, along with the square-shaped opposite ends 26 and 27. For the positioning and guiding of the insert 24 in the tool, as shown in FIG. 8, the insert sides 28 are respectively engaged by the two fingers 14, and the insert is thereby flanked by the fingers 14. That arrangement rotationally orientates the insert 24 with the handle portion of the tool for the mating of the insert end 27 with the socket 23 in the FIG. 11 mating. Also, the orientations and dispositions of the fingers 14 and the socket 23 are mutually arranged so that mating will take effect when the insert is moved axially rightward, as viewed in these drawings, to thus have the insert end 27 enter the socket 23, as shown in FIG. 11. It will be seen that the insert 24 is symmetrical in its end-to-end shape, and either insert end 26 or 27 can be disposed to enter either socket 22 or 23. That is, the insert is end-to-end reversible in its assembled disposition in the tool shown, and it is shown to have an hour-glass side view configuration. Also, it is readily apparent the male and female relationship between the insert 24 and the sockets 22 and 23 can be reversed so that the female portion is on the inserts.

Figures 12, 13, 14, 15:
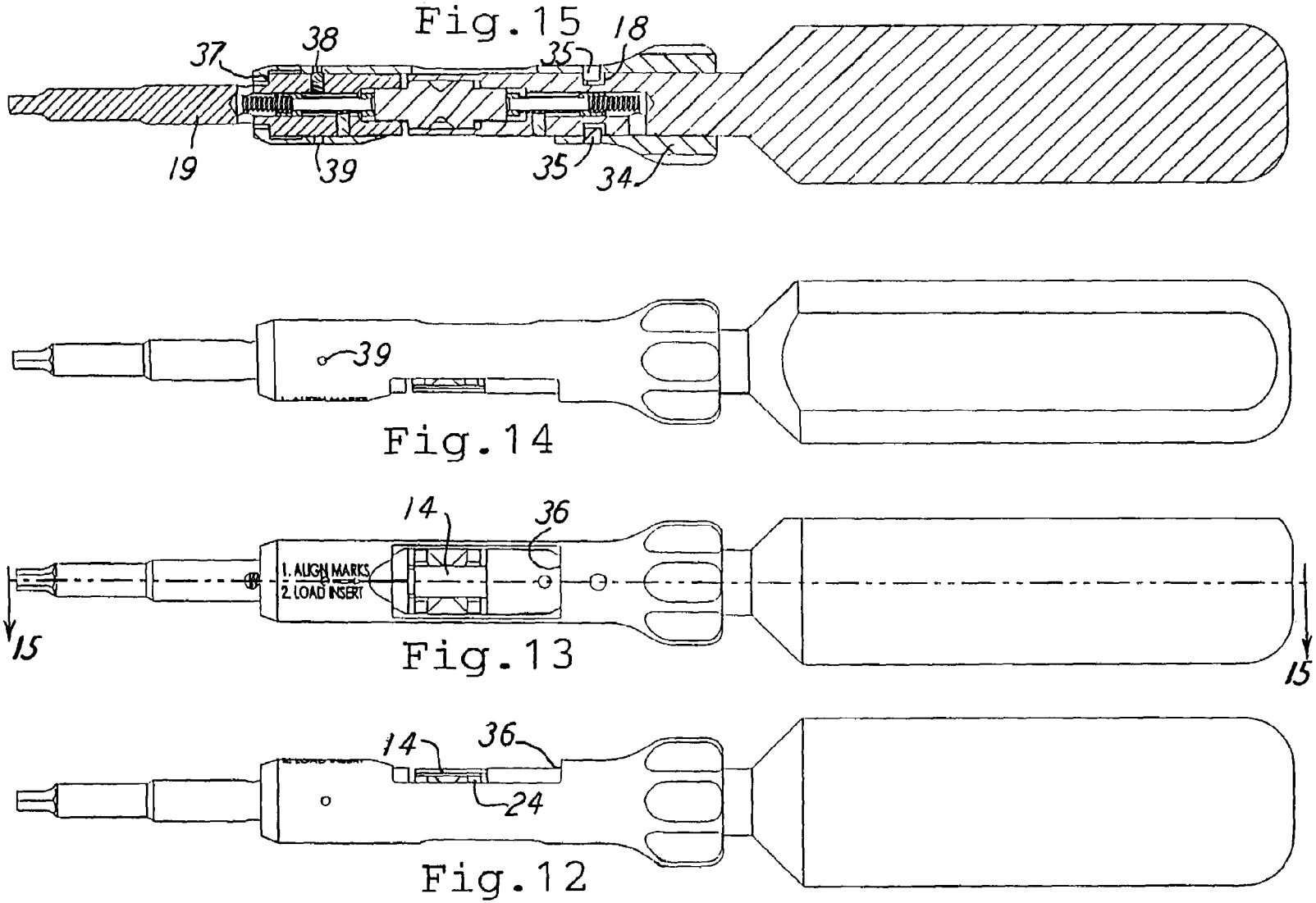
FIG. 12 is the FIG. 9 side elevation view, but with the tool in a rotated closed mode.
FIG. 13 is a top plan view of FIG. 12.
FIG. 14 is a top plan view of FIG. 13.
FIG. 15 is a section view taken on a plane designated by the line 15—15 of FIG. 13.

A control sleeve 34 is snugly slidably telescoped over the handle extension portion 13 and can slide axially thereon. FIG. 15 shows that the sleeve 34 has two pins 35 extending radially thereon and respectively into the grooves 16 and 17 and then into grooves 18. That initially rotationally aligns the sleeve 34 relative to the handle 11. There is a central opening 36 in the sleeve 34 for access to the interior reception space in sleeve 34.

The bit 19 is initially axially snugly inserted into the sleeve to shoulder therewith at 37, so rightward axial movement of the sleeve 34 will likewise move the bit 19. The sleeve 34, bit 19, and handle extension 13 are cylindrical and snug on their cylindrical shapes at 40 of FIG. 4. The bit 19 and sleeve 34 are rotationally related by a spring-loaded detent ball 38 on the bit 19 and by corresponding circular openings 39 on the sleeve 34. There are four openings 39 circumferentially equally disposed around and on the sleeve 34 so the bit 19 can be selected to be in either of four quarter-turn rotated positions about axis A and again be connected with the detent ball 38. That sustains an axial relationship between the bit 19 and the sleeve 34 and it presents rotational orientation with the square shape of the opening 22.

FIGS. 25–28 show that the bit 19 has four equally spaced alignment marks 41 thereon. The sleeve 34 has an alignment 42 thereon, and one of the marks 41 on the bit can be aligned by the user with the mark 42, as seen in FIG. 6. FIG. 6, for one, shows the indicia "1. ALIGN MARKS" and "2. LOAD INSERT" adjacent the mark 42 for user guidance. The detent 38 can assure that alignment. With the marks 41 and 42 thusly axially aligned, the sleeve 34 can be slid rightward on the handle 11 to thereby mate the insert end 26 with the socket 22. That telescopic sliding also mates the insert end 27 with the socket 23, all as seen in FIG. 15.

Figure 10:
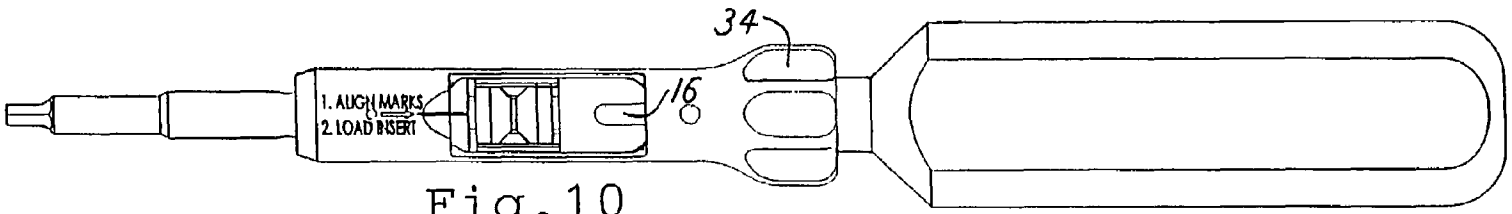
FIG. 10 is a top view of FIG. 9.
Figure 9:
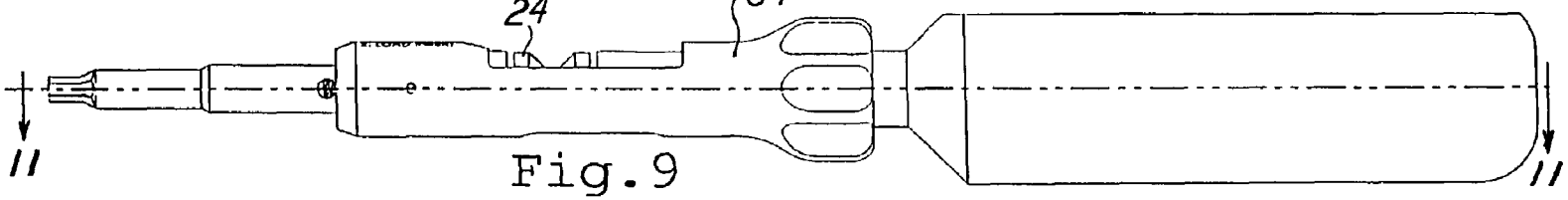
FIG. 9 is the FIG. 5 side elevation view, but with the tool in a retracted mode.
Figures 32, 33:
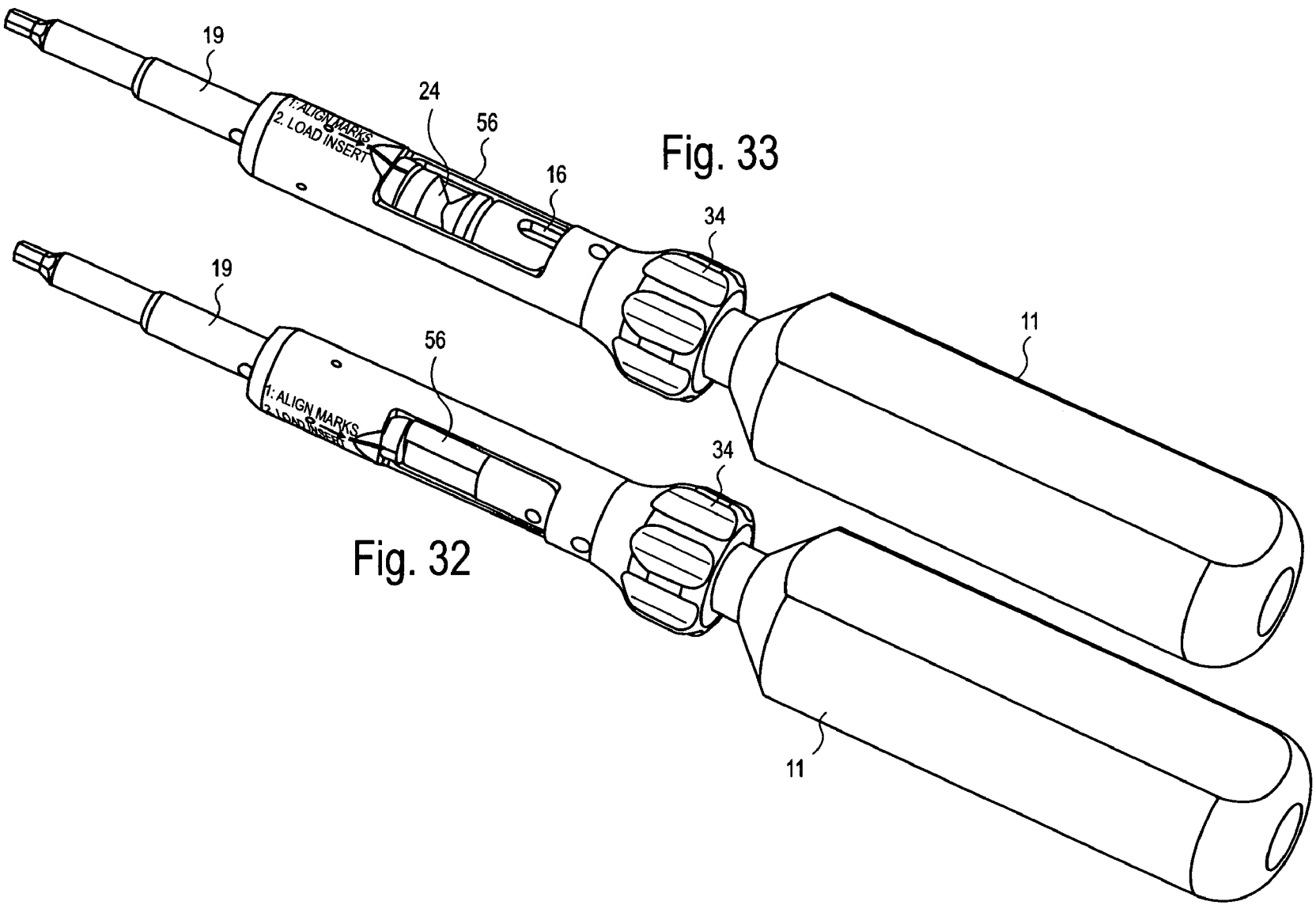
FIG. 32 is a top perspective view of the tool in the retracted mode shown in FIG. 10.
FIG. 33 is a top perspective view of the tool in the closed mode shown in FIG. 13.

In that telescopic sliding, the pins 35 slide in the respective grooves 16 and 17, to the FIG. 10 position, and the sleeve can then be rotated about axis A to have the pins move into the grooves 18 and thereby axially lock the tool with the insert in the retracted mode seen in FIGS. 15 and 32.

In that arrangement, rotational drive connection is achieved between the handle 11 and the bit 19, and that is through the insert 24. The selected one of the inserts, for insertion into the tool, as described, can have a material-reduced extent at 43, and that can provide the weakness and shear-breaking portion of the insert and thereby present a limit to the amount of torque transmitted through the insert and thus by the tool. The insert is intended to shear at 43 when subjected to a predetermined and proscribed maximum torque applied by the user's hand on the handle 11.

Figure 22:
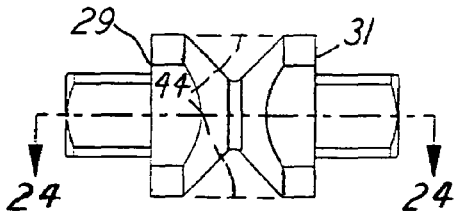
Figure 27:
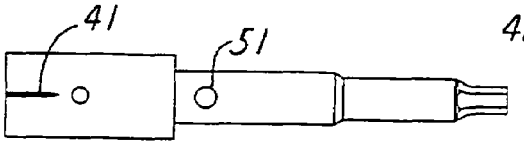
FIGS. 26, 27, 28, and 29 are respectively top plan, front elevation, bottom plan, and right end elevation views of FIG. 25.
Figure 25:
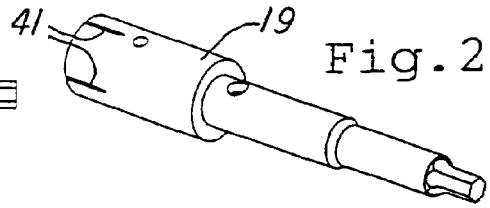
FIG. 25 is a perspective view of a part shown in FIG. 10.
Figure 26:
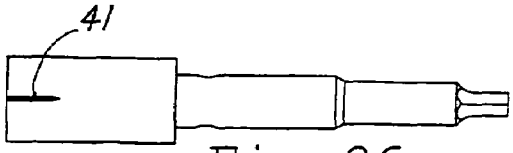
Figure 29:
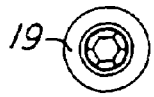
Figure 28:
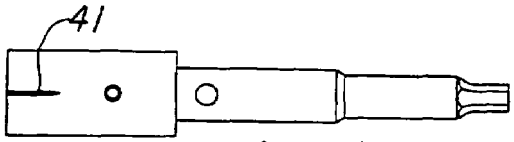

Alternative to having a limit torque tool arrangement as mentioned, the insert could be shaped or otherwise constructed to resist shearing and thereby be an insert of unlimited torque transmission, and that could be to simply have the insert of one constant thickness dimension, as shown by the broken lines 44 in FIG. 22, throughout its length between the drive ends 26 and 27. Also, the material for the making of the insert could be selected to thereby control the amount of torque transmitted by selecting the strength of the material relative to shear.

Figure 30:
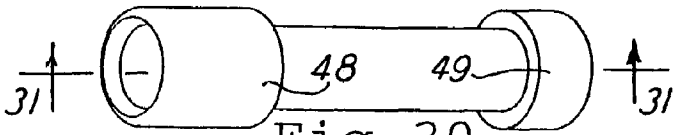
FIG. 30 is an enlarged perspective view of a sectioned part shown in FIG. 11.
Figure 31:
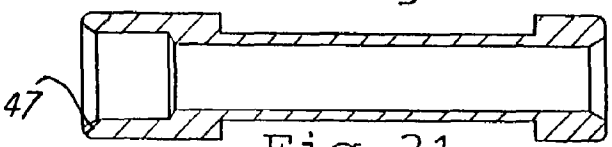
FIG. 31 is a section view taken on a plane designated by a line 31—31 in FIG. 30.
Figure 16:
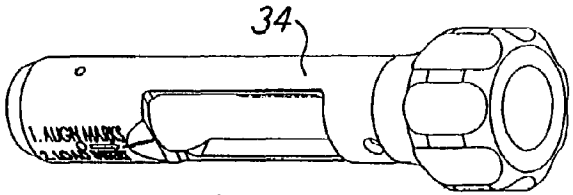
FIG. 16 is a perspective view of a part shown in FIG. 10, but in a rotated position.

The bit 19 has an axial opening 46 in FIG. 4, and a plunger 47 is slidable in the opening 46. The plunger 47 has two radially enlarged ends 48 and 49, and a pin 51 is fixed on the bit 19 and extends into axial interference fit with the ends 48 and 49 to thereby restrict axial movement of the plunger relative to the bit 19. FIGS. 30 and 31 show the details of the plunger 47. A compression spring 52 abuts between the bit 19 and the plunger 47 to urge that plunger 47 rightwardly as viewed herein, and that is axially against the insert 24.

Similar to the foregoing, the handle extension 13 has an axial bore 53, and another of the plunger 47 is slidably disposed in the bore 53 and is axially urged by another of the spring 52, as shown in FIG. 4. The springs 52 are of the same compressive strength for exerting equal axial forces inwardly onto the insert 24. So the insert 24 is hand-placed between the plungers 47, in a reception space 57, and the springs 52 position the insert 24 intermediate the bit 19 and the handle 11. If and when the insert 24 is sheared in half, such as by being subjected to the torque limit for which it is intended and designed, then the plungers 47 and the springs 52 will urge the respective broken halves of the insert 24 to align with the sleeve opening 36 for removal of the insert two parts. That would occur when the sleeve 34 is moved leftward to the FIG. 6 position.

FIG. 1 shows the sleeve 34 has a portion 56 of its cylindrical shape adjacent the opening 36 to be rotatable and enclosable over the insert 24 when the entire sleeve 34 is rotated from the position of FIG. 33 to the position of FIG.

32 and it thereby, along with the fingers 14, secures the insert 24 in the reception space 57. Upon that rotation, the ball detent 38 will automatically retract from the hole 39 and allow the sleeve 34 to rotate one-quarter revolution and again seat in the then newly aligned hole 39 to continue to keep the bit 19 axially fixed with the sleeve 34, as desired. In FIG. 3, the sleeve 34 has a second opening 58 diametrically opposite to the opening 36, and that can be for clean-out, inspection, or the like.

With the foregoing disclosure, the method of arranging the tool is disclosed in detail. One skilled in the art will understand that the method is the arranging of the handle 11 and the bit 19 with the reception space 57 therebetween. The insert 24 is placed in the space in rotation-drive connection with the handle and the bit for transmitting torque therebetween. The individual inserts 24 can be of individual shapes and functions relative to both the solid line and broken line showings in FIG. 22. Thus both limit torque and unlimited torque may be selectively applied by the tool, according to the selection of the insert from a plurality or kit of inserts.

With sleeve 34 aligned in slots 16 and 17 through pins 35, orientation of sleeve alignment mark 42 is established, including according to the alignment of socket 23 on handle 11. Then, alignment of the bit alignment mark 41 with the mark 42 aligns both sockets 22 and 23 with each other for rotation drive connection with the insert 24. Also, with the pins 35 in their final and working positions in slots 18, the handle 11 and the bit 19 are axially secured together and can not move axially apart until the pins 35 are rotated out of slots 18. The tool can exert torque in either axial direction about axis A because that hand driven torque is applied directly from the handle to the bit 19 through the insert 24. The sleeve 34 serves as an insert locking member.

While detailed descriptions of both the apparatus and method are included herein, it should be apparent to one skilled in the art that changes could be made therein. Therefore, the scope of the invention should be judged by the claims attached hereto.

What is claimed is:

1. A rotatable hand tool for controlling torque applied at a rotation axis, comprising:

a handle for rotation about said axis, a bit connected to said handle and said bit aligned along said axis and presenting a reception space therebetween and being relatively movable toward and away from each other along said axis, a torque-transmitting insert in said reception space and interconnecting said handle and said bit rotationally together through said insert when said handle and said bit are positioned toward each other along said axis, and a member connected between said handle and said bit for releasably restraining said relative movement of said handle and said bit away from each other along said axis and thereby retain said insert in said reception space;

said member being rotationally telescoped over said handle and said bit and having a pin and groove connection between said member and said handle whereby movement of said member provides relative movement between said pin and said groove for the release and restraint of relative movement of said handle and said bit.

2. The rotatable hand tool for controlling torque, as claimed in claim 1, including:

a plurality of said inserts with torque shear strengths different from each other and with each thereof being arranged to interconnect with said handle and said bit and thereby be selectable for individual use in said tool.

3. The rotatable hand tool for controlling torque, as claimed in claim 1, including:

said bit and said member being relatively related for movement together along said axis and relative to said handle for reducing said reception space between said bit and said handle upon movement of said bit and said member along said axis and thereby connect with said insert.

4. The rotatable hand tool for controlling torque, as claimed in claim 1, including:

said member extending adjacent to said reception space, and said member having a passageway for access to said reception space for passage of said insert into and out of said reception space.

5. The a rotatable hand tool for controlling torque, as claimed in claim 1, including:

a spring operative on said insert for moving said insert along said axis when said handle and said bit are spaced away from each other along said axis.

6. The rotatable hand tool for controlling torque, as claimed in claim 1, including:

contacting surfaces in mutual contact on said handle and said insert and thereby orientate said insert in said reception space for rotation drive connection between said insert and said handle.

* * * * *